US005956973A

United States Patent [19]

Herron et al.

[11] Patent Number: 5,956,973

[45] Date of Patent: Sep. 28, 1999

[54] AIR SEPARATION WITH INTERMEDIATE PRESSURE VAPORIZATION AND EXPANSION

[75] Inventors: Donn Michael Herron, Fogelsville; Rakesh Agrawal, Emmaus, both of Pa.

[73] Assignee: Air Products and Chemicals, Inc., Allentown, Pa.

[21] Appl. No.: 08/929,813

[22] Filed: Sep. 15, 1997

Related U.S. Application Data

[63] Continuation-in-part of application No. 08/798,893, Feb. 11, 1997.

[51] Int. Cl.[6] ..... F25J 3/04

[52] U.S. Cl. ..... 62/646; 62/924

[58] Field of Search ..... 62/645, 646, 649, 62/652, 924

[56] References Cited

U.S. PATENT DOCUMENTS

| | | | |
|---|---|---|---|
| 2,520,862 | 8/1950 | Swearingen | 62/646 |
| 2,753,698 | 7/1956 | Jakob | 62/652 |
| 3,210,948 | 10/1965 | Schilling | 62/646 |
| 4,737,177 | 4/1988 | Erickson . | |
| 4,783,208 | 11/1988 | Rathbone | 62/924 X |
| 4,854,954 | 8/1989 | Erickson | 62/924 X |
| 5,078,766 | 1/1992 | Guilleminot | 62/924 X |
| 5,245,831 | 9/1993 | Agrawal et al. . | |
| 5,263,327 | 11/1993 | Drnevich et al. | 62/646 |
| 5,386,691 | 2/1995 | Bonaquist et al. . | |
| 5,398,514 | 3/1995 | Roberts et al. . | |
| 5,469,710 | 11/1995 | Howard et al. . | |
| 5,689,975 | 11/1997 | Oakey et al. | 62/653 |

FOREIGN PATENT DOCUMENTS 2854508 12/1981 Germany .

OTHER PUBLICATIONS

Latimer, R. E., "Distillation of Air", *Chemical Engineering Progress*, 63 (2), 35–59 (1967).

*Primary Examiner*—Christopher B. Kilner
*Attorney, Agent, or Firm*—John M. Fernbacher

[57] ABSTRACT

A double column cryogenic air separation system is operated to increase boilup in the lower pressure column by vaporizing at an intermediate pressure a liquid stream containing at least 20 mole % oxygen, work expanding the stream, and introducing the resulting expanded stream into the lower pressure column. Operation in this mode increases oxygen recovery at a given rate of compressed and purified air feed or reduces the amount air feed required to produce a given rate of oxygen product. Argon recovery can be integrated efficiently with the intermediate pressure vaporization and work expansion steps.

20 Claims, 3 Drawing Sheets

AIR SEPARATION WITH INTERMEDIATE PRESSURE VAPORIZATION AND EXPANSION

CROSS-REFERENCE TO RELATED APPLICATIONS

This is a Continuation-in-Part of U.S. Ser. No. 08/798,893 filed on Feb. 11, 1997.

STATEMENT REGARDING FEDERALLY SPONSORED RESEARCH OR DEVELOPMENT

Not applicable.

BACKGROUND OF THE INVENTION

Air can be separated by the well-known cryogenic distillation process utilizing a thermally-linked double distillation column system to recover oxygen and nitrogen. A representative description of this well-known method is disclosed in an article by R. E. Latimer entitled "Distillation of Air" in *Chemical Engineering Progress*, 63 (2), 35–59 [1967]. A third distillation column may be integrated with the double column system to increase the overall separation efficiency. Optionally, argon may be recovered from an intermediate sidestream in a separate argon distillation column.

In the operation of double-column cryogenic air separation systems, it is generally accepted that the amount of boilup vapor in the bottom section of the lower pressure column is a major factor in determining the oxygen recovery from feed air. If the boilup rate is reduced, oxygen recovery likewise declines. This decline in oxygen recovery with decreasing boilup is greater when the oxygen product purity is above about 98 mole %.

Several features of the double column process can reduce boilup and thereby reduce oxygen recovery. In one example, it is beneficial to withdrawn some or all of the desired nitrogen product from the higher pressure column rather than from the lower pressure column. This is advantageous and eliminates stages of nitrogen product compression, which in turn reduces capital and in some cases reduces power consumption. A disadvantage occurs, however, because as nitrogen vapor is withdrawn from the higher pressure column, boilup in the lower pressure column is reduced and oxygen recovery declines.

Refrigeration is required in the air separation process to counteract heat leak from the ambient environment and to produce some or all of the products as liquids if desired. This refrigeration typically is provided by work expansion of selected process streams. When the refrigeration demand is moderate, the refrigeration can be provided by work expanding a portion of the high pressure air feed directly into the lower pressure column. In this case, vapor flow to the higher pressure column is necessarily reduced and boilup in the bottom of the lower pressure column is also reduced, and as a result oxygen recovery declines.

Another common means of providing refrigeration is to work expand an air feed stream into the higher pressure column. In this case, it is necessary to compress the air before expansion to a pressure greater than the higher pressure column, which adds incremental power and capital costs.

Numerous ideas have been proposed in the art to increase boilup in the bottom of the lower pressure column. These ideas can be grouped into four categories: (1) raising the pressure of the stream which is to be expanded to the lower pressure column with a compressor, (2) expanding to the higher pressure column, (3) heat pumping the lower section of the lower pressure column, and (4) boiling a liquid within the process and expanding the resultant vapor.

The benefit of raising the pressure of the stream to be expanded to the lower pressure column is disclosed in German Patent DE 28 54 508 which proposes using the energy generated by the expander to drive a compressor to increase the pressure of the fluid to be expanded. This technique has the desired effect of reducing the expander flow and is commonly used in the air separation industry.

Another common practice is to expand feed air into the higher pressure column. Examples of this technique are disclosed in U.S. Pat. Nos. 5,386,691 and 5,398,514 which teach that the expansion of air to the higher pressure column has the desired effect of increasing the boilup in the lower pressure column. However, additional compression energy must be supplied to the feed. This technique increases oxygen recovery (and argon recovery if argon is a desired product) compared with expanding air to the lower pressure column, but will not necessarily reduce the power required per unit of oxygen production.

U.S. Pat. No. 5,245,831 discloses that heat pumping the bottom section of the lower pressure column will increase the oxygen recovery. This is generally attractive only if higher argon recovery also is desired. Since external compression energy must be supplied to provide recycle flow, the power required per unit of oxygen production is largely unaffected.

An alternative method of vaporizing a liquid within the process and expanding the resultant vapor, which increases argon recovery and generates increased refrigeration, is disclosed in U.S. Pat. No. 4,737,177. The higher pressure column bottoms stream is partially vaporized in an intermediate condenser of the argon column. The vaporization occurs at an intermediate pressure, and the resultant vapor is warmed and work expanded to produce refrigeration. The expanded stream provides feed to the lower pressure column. U.S. Pat. No. 5,469,710 discloses a related application of vaporizing and expanding into the lower pressure column wherein liquid is boiled at the top of the argon column to provide all the argon column reflux. The vapor which is produced by the boiling is warmed, turboexpanded to produce refrigeration, and then routed to the lower pressure column as a feed. The source of the liquid for vaporization is either the liquid from the partial or total condensation of feed air or the bottoms liquid from the higher pressure column. The benefit of increasing boilup is greater when the oxygen product purity is above about 98 mole %.

Methods which increase the boilup rate in the lower pressure column are desirable to increase oxygen recovery, especially when a high purity oxygen product is required. Methods which do not require increased compression capacity to obtain this increase in boilup are preferred. The present invention as disclosed below and defined by the claims which follow is a method which provides refrigeration for the air separation system while increasing the lower pressure column boilup rate without additional compression requirements for work expansion refrigeration.

BRIEF SUMMARY OF THE INVENTION

In the well-known process for the separation of air in a cryogenic air separation system comprising a higher pressure distillation column and a lower pressure distillation column thermally linked with the higher pressure distillation column, air is compressed and purified to remove higher boiling contaminants, at least a portion of the compressed purified air is cooled and distilled in the higher pressure column, at least a portion of the bottoms liquid from the higher pressure column is distilled in the lower pressure column, and at least one nitrogen-enriched stream and at least one oxygen-enriched stream are withdrawn from the system. The present invention is a method for providing a portion of the refrigeration required for operation of the air separation system which method comprises:

(a) vaporizing a condensed liquid containing at least about 20 mole % oxygen at a pressure between any pressure in the lower pressure column and any pressure in the higher pressure column to yield an intermediate pressure vapor;

(b) work expanding the intermediate pressure vapor and introducing the resulting work-expanded stream into the lower pressure column; and (c) providing the heat for vaporizing the liquid in step (a) by indirect heat exchange with at least a portion of a sidestream vapor withdrawn from the lower pressure column to yield a cooled intermediate stream.

The condensed liquid containing at least about 20 mole % oxygen preferably is provided by a portion of the bottoms liquid from the higher pressure column. The portion of the bottoms liquid from the higher pressure column can be cooled and reduced in pressure prior to vaporization. The sidestream vapor of step (c) typically contains less than about 5 mole % nitrogen. The vaporizing of the condensed liquid in step (a) also may yield an intermediate pressure liquid, which then can be reduced in pressure and introduced into the lower pressure column. The cooled intermediate stream of step (c), which can be partially or completely condensed, i.e. can be a two-phase vapor-liquid stream or a single phase liquid stream, preferably is returned to the lower pressure column. The intermediate pressure vapor can be warmed prior to work expansion.

In a further embodiment of the invention, the cooled intermediate stream of step (c) is introduced into an argon recovery distillation column. A portion of the sidestream vapor withdrawn from the lower pressure column in step (c) also can be introduced into the argon recovery distillation column. An argon-enriched overhead stream is withdrawn from the argon recovery distillation column and cooled, at least a portion of the resulting cooled argon-enriched overhead returned as condensate to the column as reflux, and a remaining cooled argon-enriched stream withdrawn as a product. The cooled argon enriched stream can be partially or completely condensed, i.e. can be a two-phase vapor-liquid stream or a single phase liquid stream.

The vaporizing of the condensed liquid in step (a) also may yield an intermediate pressure liquid, which in this embodiment may be reduced in pressure and warmed by indirect heat exchange with the argon-enriched overhead stream, thereby providing the cooled argon-enriched overhead and yielding a warmed, reduced-pressure intermediate stream.

A liquid bottoms stream can be withdrawn from the argon recovery distillation column and introduced into the lower pressure column. Optionally, the warmed, reduced-pressure intermediate stream is introduced into the lower pressure column.

A nitrogen product may be withdrawn from the top of the higher pressure column as a vapor and warmed to ambient temperature to provide a nitrogen gas product. Alternatively, the nitrogen can be withdrawn from the top of the higher pressure column as a liquid, the liquid pumped to an elevated pressure, and the liquid vaporized to provide a high pressure nitrogen gas product. If desired, a nitrogen product can be withdrawn from the top of the higher pressure column as a liquid, the liquid pumped to an elevated pressure, and the liquid vaporized to provide a high pressure nitrogen gas product, while simultaneously a second nitrogen product may be withdrawn from the top of the higher pressure column as a vapor and warmed to ambient temperature to provide a nitrogen gas product.

An oxygen stream can be withdrawn from the bottom of the lower pressure column to provide a primary oxygen product. In addition, an intermediate oxygen stream may be withdrawn from a point above the bottom of the lower pressure column to provide an intermediate oxygen product. The intermediate oxygen product will have a lower purity than the primary oxygen product.

DETAILED DESCRIPTION OF THE INVENTION

In the operation of double column air separation systems, it is generally accepted that the amount of boilup vapor in the bottom section of the lower pressure column is a major factor in determining the oxygen recovery from feed air. If the boilup rate is reduced, oxygen recovery likewise declines. This decline in oxygen recovery with decreasing boilup is greater when the oxygen product purity is above about 98 mole %. Methods which increase the boilup rate in the low pressure column are therefore desirable, especially when a high purity oxygen product is required. The present invention as described in detail below is a method to provide refrigeration for the air separation system while increasing the low pressure column boilup rate.

Figure 1:
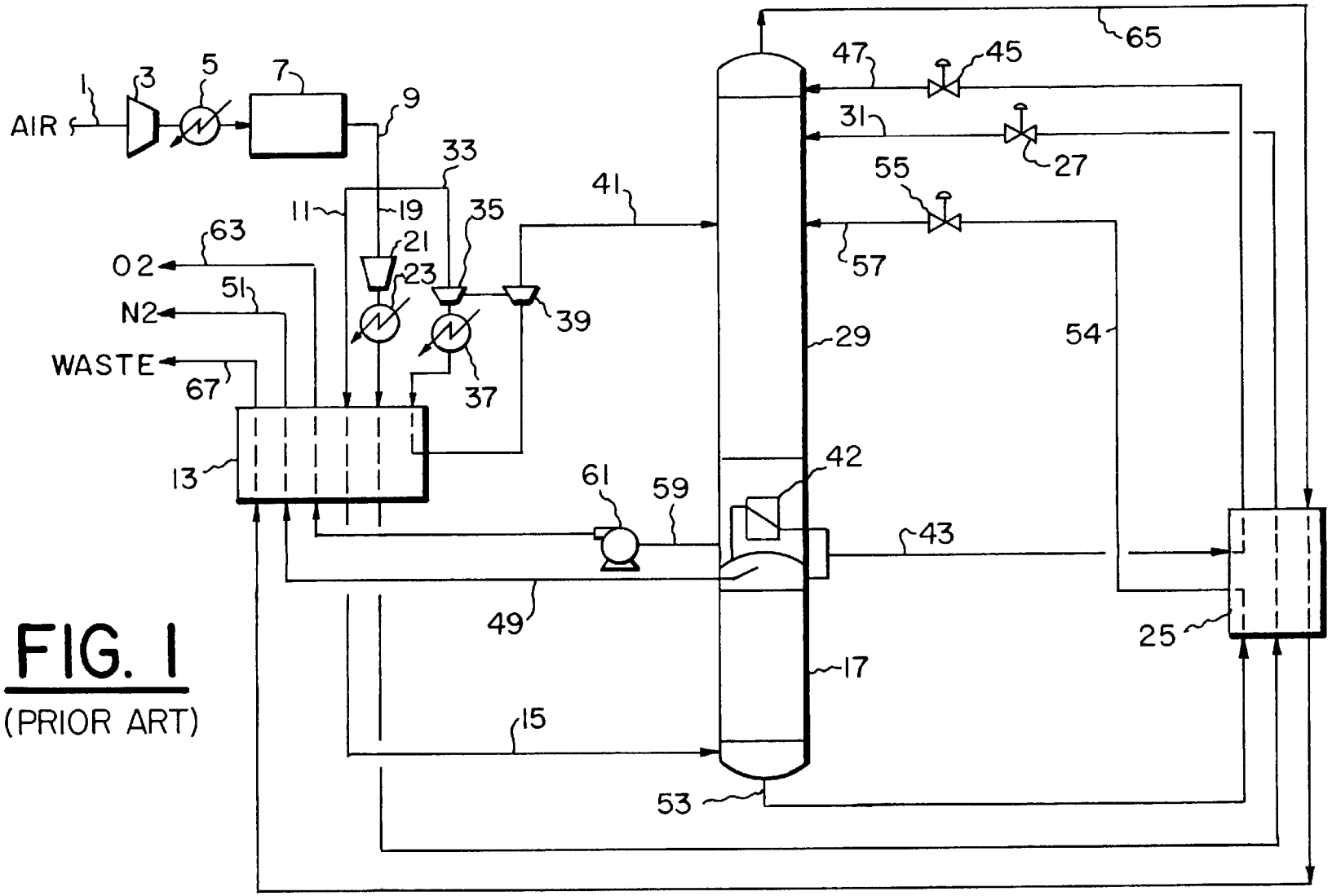
FIG. 1 (PRIOR ART)
FIG. 1 is a schematic flow diagram of a double-column cryogenic air separation system according to the prior art.

Oxygen and nitrogen are produced in a standard double column distillation system of the type known in the art as shown in FIG. 1. Air 1 is compressed in main air compressor 3 to a representative pressure of approximately 80 psia, but can be any appropriate pressure above about 50 psia. The compressed air is cooled in cooler 5, and is processed in adsorptive purification system 7 to remove higher boiling point contaminants such as water, $CO_2$, and hydrocarbons to prevent the freezing of these components downstream. Purified feed air 9 is split into three streams. Stream 11, which typically is about 60% of the feed air 9, is cooled in main heat exchanger 13 to yield cooled air 15 which is introduced as feed at the bottom of higher pressure distillation column 17. Stream 19, typically about 30% of feed air 9, is further compressed in booster compressor 21, is cooled to near ambient temperature in cooler 23, is further cooled and liquefied in main heat exchanger 13, is further cooled in heat exchanger 25, is reduced in pressure across throttling valve 27, and is introduced to the lower pressure column 29 as low pressure feed 31.

The remainder of feed air 9, stream 33, is further compressed in compressor 35, is cooled to near ambient temperature in cooler 37, is further cooled in main heat exchanger 13, is work expanded in turboexpander 39 which effects further cooling, and the resulting cooled expanded stream 41 is introduced into lower pressure column 29. This feature is commonly termed an air expander, and compressor 35 and turboexpander 39 typically are mechanically linked so that the turboexpander drives the compressor. Higher pressure column 17 and lower pressure column 29 are thermally linked by reboiler-condenser 42 as is known in the art.

In higher pressure column 17, air is rectified to produce three streams. The first of these is nitrogen-enriched liquid overhead 43, which is cooled in exchanger 25, is reduced in pressure across throttling valve 45, and is introduced into the lower pressure column 29 as low pressure feed 47. The second stream is nitrogen-enriched vapor 49, which is warmed in main heat exchanger 13 to yield nitrogen product 51. The third stream is oxygen-enriched bottoms 53 which is cooled in heat exchanger 25, is reduced in pressure across throttling valve 55, and is introduced into lower pressure column 29 as low pressure feed 57.

In lower pressure column 29 the three feed streams are separated into liquid oxygen 59, which is pumped to a desired pressure in pump 61 and vaporized in main heat exchanger 13 to yield high pressure oxygen product 63, and low pressure overhead vapor 65 which is warmed in heat exchangers 25 and 13 to yield waste stream 67.

Figure 2:
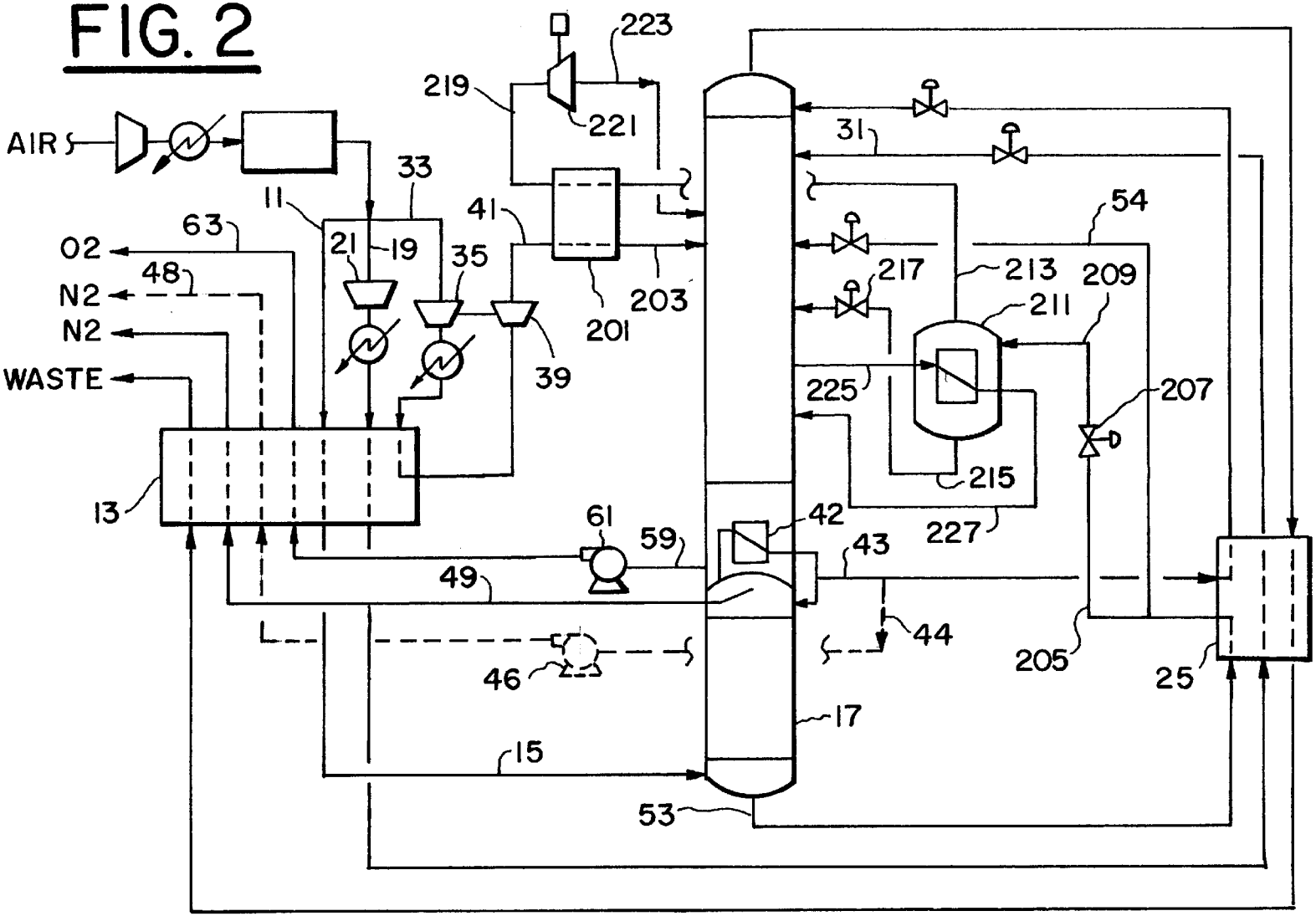
FIG. 2 is a schematic flow diagram of a double-column cryogenic air separation system according to the present invention.

The present invention is shown in FIG. 2 in relation to the prior art process of FIG. 1. In the present invention, cooled expanded air stream 41 is cooled further in heat exchanger 201 before being introduced to lower pressure column 29 as further cooled feed stream 203. Oxygen-enriched bottoms 53 from higher pressure column 17, after cooled in heat exchanger 25, is split into two streams: stream 54 as described above which is throttled and passed into lower pressure column 29, and stream 205 which is throttled through valve 207 to an intermediate pressure between the pressure at any point in higher pressure column 17 and the pressure at any point in lower pressure column 29. The pressure of throttled stream 209 usually is about 10 to 20 psi above the highest pressure in lower pressure column 29. Throttled stream 209 passes into reboiler heat exchanger 211 and is partially vaporized therein to produce intermediate pressure vapor 213 and intermediate pressure liquid 215. Liquid 215 is reduced in pressure across throttling valve 217 and introduced into lower pressure column 29. Vapor 213 is warmed in heat exchanger 201, thereby cooling stream 41 as earlier described, and the resulting warmed intermediate pressure stream 219 is work expanded in turboexpander 221. The resulting cooled and expanded stream 223 is introduced into lower pressure column 29.

Sidestream vapor 225 is withdrawn from lower pressure column 29 and is cooled and partially or fully condensed in boiling-condensing heat exchanger 211, thereby providing heat for the partial vaporization of stream 209 as earlier described. Cooled stream 227, which can be partially or fully condensed, is returned to lower pressure column 29 at an appropriate location.

The use of sidestream 225 to vaporize intermediate pressure stream 209 prior to work expansion of vapor 219 (after optionally warming in heat exchanger 201) is an important feature of the present invention. The refrigeration produced by work expansion across turboexpander 221 reduces the refrigeration required from turboexpander 39, which in turn reduces the required flow of stream 33. This increases the flow of cooled air 15 into higher pressure column 17, which in turn increases the boilup effected by reboiler-condenser 42 in the bottom of lower pressure column 29, which has the final beneficial effect of increased oxygen recovery in a higher flow of oxygen product stream 59.

Figure 3:
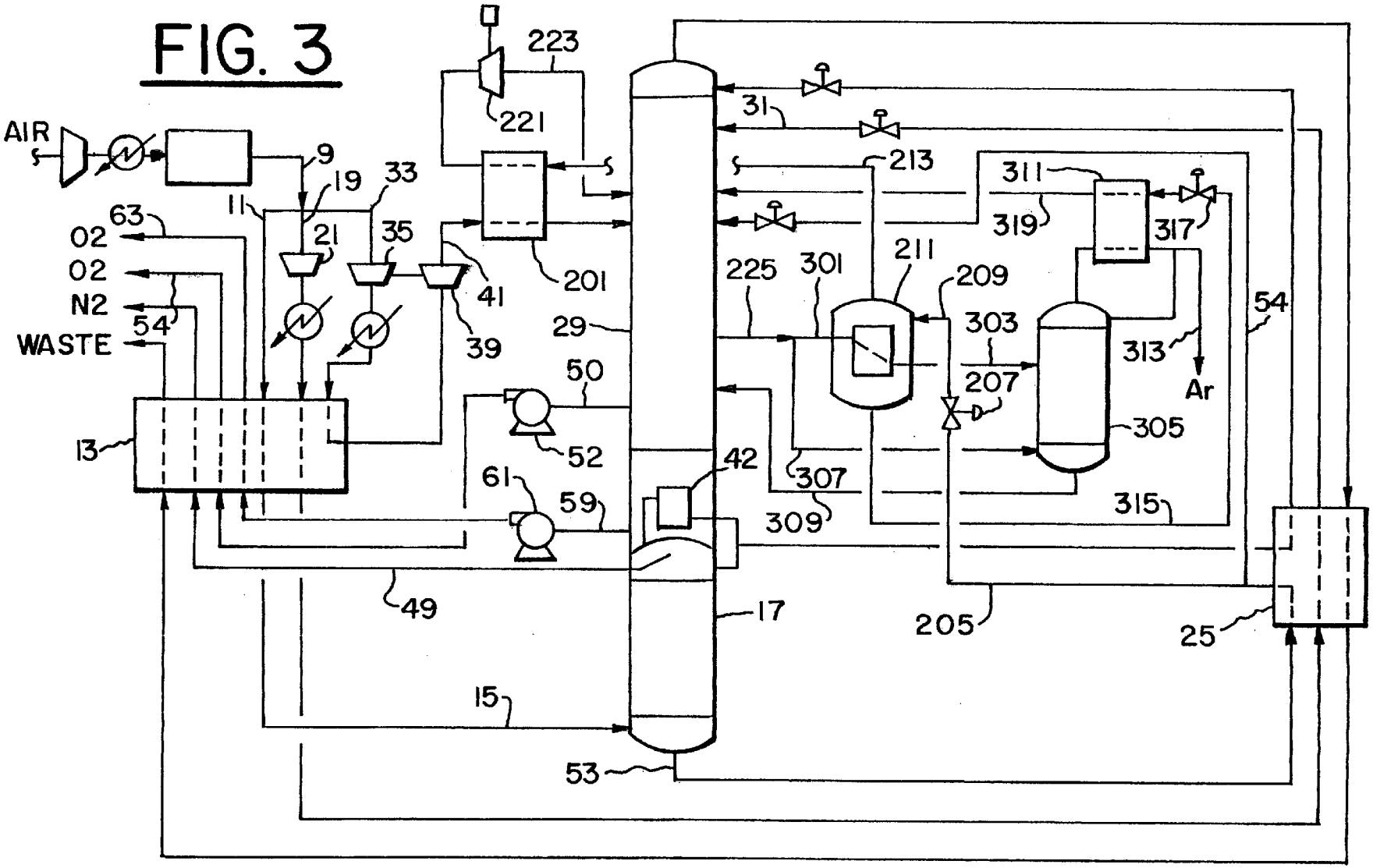
FIG. 3 is a schematic flow diagram of a double-column cryogenic air separation system with an argon recovery column according to the present invention.

An alternative embodiment of the invention is shown in FIG. 3. A portion 301 of sidestream 225 from lower pressure column 29 is at least partially condensed in heat exchanger 211 and the resulting stream 303 is introduced into argon recovery distillation column 305. The remainder 307 of sidestream 225 is introduced at the bottom of argon recovery distillation column 305. Argon-depleted bottoms stream 309 is withdrawn and returned to lower pressure column 29. Argon-enriched overhead vapor from argon column 305 is partially or totally condensed in condenser 311; a portion of the resulting condensate provides reflux for the column and the remainder is withdrawn as argon-enriched product 313.

Cooling for the condensation of stream 301 in reboiler-condenser heat exchanger 211 is provided by the partial vaporization of stream 209 as described in reference to FIG. 2. Vapor 213 is optionally warmed in heat exchanger 201 and work expanded in turboexpander 221 as previously described. Liquid 315 from heat exchanger 211 is reduced in pressure across throttling valve 317 and provides the necessary cooling by indirect heat transfer in condenser 311 to condense partially or completely the overhead vapor from argon recovery distillation column 305. The resulting vaporized stream 319 is introduced into lower pressure distillation column 29.

In the embodiment of FIG. 3, as in the embodiment of FIG. 2, the refrigeration produced by work expansion across turboexpander 221 reduces the refrigeration required from turboexpander 39, which in turn reduces the required flow of stream 33. This increases the flow of cooled air 15 into higher pressure column 17, which in turn increases the boilup effected by reboiler-condenser 42 in the bottom of lower pressure column 29, which has the final beneficial effect of increased oxygen recovery in a higher flow of oxygen stream 59. In addition, argon recovery is increased over the recovery realized if work expansion across turboexpander 221 were not used.

In the process descriptions of this disclosure, the term "enriched" is applied to a component in a stream withdrawn from a separation step which contains a higher mole fraction of the component than that present in the total feed to the step. The total feed can comprise a single feed or multiple feed streams.

Process variations are possible in the invention as embodied in FIGS. 2 and 3. In one variation, condensed stream 303 of FIG. 3 can be mixed with return bottoms liquid 309 from the argon recovery distillation column 305 for equipment simplification. In another option, vapor 301 can be provided to reboiler-condenser heat exchanger 211 from another location in lower pressure column 29, with stream 307 providing feed to argon recovery distillation column 305 and stream 303 returning to lower pressure column 29.

Other variations to the present invention are possible. For example, oxygen product 63 could be provided as a gas by vaporizing liquid oxygen 59 at the pressure of lower pressure column 29, in which case the air booster compressor 21 and pump 61 would not be required and the flow of air stream 19 would be included in stream 11. In another alternative, the air expander comprising compressor 35 and turboexpander 39 as shown in FIGS. 2 and 3 could be replaced by alternative air expander configurations.

Heat exchanger 201 as shown in FIGS. 2 and 3 warms vapor 213 prior to work expansion in turboexpander 221. Alternative configurations can be used, for example, such as warming stream 213 in heat exchanger 25 before work expansion. Optionally, stream 213 can be warmed partially in heat exchanger 25 and further warmed in main heat exchanger 13 before work expansion. In another alternative, stream 213 can be work expanded without preheating, in which case discharge 41 of turboexpander 39 passes directly into lower pressure column 29. In yet another alternative, work-expanded stream 223 can be cooled by indirect heat exchange prior to introduction into lower pressure column 29.

As shown in FIGS. 2 and 3, nitrogen product 49 is withdrawn as a vapor from higher pressure column 17. Alternatively, nitrogen product can be withdrawn from the top of lower pressure column 29 in addition to or instead of higher pressure column 17. In another alternative mode, a portion 44 of nitrogen-enriched liquid overhead 43 from higher pressure column 17 (FIG. 2) is pressurized in pump 46 and vaporized in exchanger 13 to provide high pressure nitrogen product 48. This alternative mode also can be used in the embodiment of FIG. 3 (not shown). If desired, dual nitrogen products 44 and 49 can be withdrawn simultaneously from higher pressure column 17.

Liquid oxygen 59 can be withdrawn from the bottom of the lower pressure column, pressurized in pump 61, and vaporized in exchanger 13 to provide a primary oxygen product 63 typically containing at least about 98 mole % oxygen. If desired, some or all of liquid oxygen 59 can be withdrawn directly as a final product without pumping or vaporization. The present invention is particularly beneficial in this case because liquid production reduces boilup in lower pressure column 29.

In addition to withdrawing a primary oxygen product as stream 59 (with or without vaporization), an intermediate oxygen stream can be withdrawn as a vapor or as a liquid from an intermediate point of lower pressure column 29 and optionally warmed to provide a lower purity oxygen product typically containing less than about 98 mole % oxygen. For example, as shown in FIG. 3, intermediate purity liquid oxygen stream 50 is withdrawn, pressurized in pump 52, and vaporized in exchanger 13 to provide lower purity oxygen product 54. This option thus provides two oxygen products at different purities, and may be beneficial in reducing the specific power for oxygen production. This option also can be used in conjunction with the embodiment of FIG. 2 (not shown).

A portion 205 of bottoms 53 from higher pressure column 17 is reduced in pressure and vaporized in heat exchanger 211 as shown in FIGS. 2 and 3. Alternatively, other liquid streams can be vaporized, such as liquid from the lower several stages of higher pressure column 17 or at least a portion of stream 31 which is liquefied by cooling in main heat exchanger 13. Another alternative is to withdraw a liquid from lower pressure column 29, pump it to an intermediate pressure, and vaporize the resulting stream in heat exchanger 211. Yet another alternative, in which feed 15 to higher pressure column 17 is partially condensed, is to separate feed 15 into vapor and liquid fractions and use some or all of the liquid fraction for vaporization in heat exchanger 211.

The bottoms stream 53 from higher pressure column 17, after cooling in heat exchanger 25, is split into streams 54 and 205 as shown in FIGS. 2 and 3. Alternatively, the flow of stream 54 could be zero, in which case all liquid would pass to heat exchanger 211 as stream 209. In yet another alternative, stream 209 can be almost completely vaporized in heat exchanger 211, in which case the flow of liquid 215 or 315 would be maintained at a minimum to provide purge for heat exchanger 211.

In FIG. 3, vapor sidestream 225 from lower pressure column 29 is split into streams 301 and 307. Alternatively, the flow of stream 307 could be zero, in which case all vapor flow would be partially condensed in heat exchanger 211 and pass as stream 303 to argon recovery distillation column 305.

The present invention is described above with respect to FIGS. 2 and 3 as an improvement to the process of FIG. 1. The invention can be applied as well to other cryogenic air separation processes which use alternative column, heat exchange, and refrigeration configurations. The benefit of work expanding a vaporized stream as described herein can be utilized in any multiple column air separation process in which increased boilup is required in the lower pressure column.

EXAMPLE

To illustrate the benefit of the present invention, computer simulations were performed for the process flowsheet of FIG. 3. In addition, simulations were performed for a base case using the process of FIG. 3 without heat exchanger 201, heat exchanger 211, and turboexpander 221 of the present invention. Both cases were based on fixed oxygen production and fixed nitrogen production from higher pressure column 17. The results of the comparison are given in Table 1.

TABLE 1

| | | Flow, lb moles/hr | |
|---|---|---|---|
| Stream Description | Stream No. (FIG. 3) | Base Case | Present Invention |
| Oxygen Product | 59 | 19.6 | 19.6 |
| Nitrogen Product | 49 | 8.0 | 8.0 |
| Air Expander Flow | 33 | 16.4 | 12.1 |
| Supplemental Expander Flow | 213 | 0.0 | 12.0* |
| Argon Product | 313 | 0.44 | 0.48 |
| Total Air Feed | 9 | 104.0 | 100.0 |

*at 36 psia

The results of Table 1 show that the base case requires 4% more air flow to provide the same flow of oxygen and nitrogen products. In addition, the process of the present invention yields 10% more argon than the base case.

Thus the present invention enables the operation of a cryogenic air distillation system at a lower feed air requirement for given oxygen and nitrogen product rates. Alternatively, a higher product recovery can be realized from a fixed flow rate of feed air. In providing a portion of the system refrigeration by vaporizing and work expanding a stream containing at least 20 mole % oxygen into the lower pressure column, increased vapor boilup is realized in the lower pressure column which leads to increased oxygen recovery. The invention is especially beneficial when a high purity oxygen product is required which contains greater than about 98 mole % oxygen.

The essential characteristics of the present invention are described completely in the foregoing disclosure. One skilled in the art can understand the invention and make various modifications without departing from the basic spirit of the invention, and without deviating from the scope and equivalents of the claims which follow.

We claim:

1. In a process for the separation of air in a cryogenic air separation system comprising a higher pressure distillation column and a lower pressure distillation column which is thermally linked with the higher pressure distillation column, wherein air is compressed and purified to remove higher boiling contaminants, at least a portion of the compressed purified air is cooled and distilled in the higher pressure column, at least a portion of the bottoms liquid from the higher pressure column is distilled in the lower pressure column, and at least one nitrogen-enriched stream and at least one oxygen-enriched stream are withdrawn from the system, a portion of the refrigeration required for operation of the air separation system is provided by a method which comprises:

(a) vaporizing a condensed liquid containing at least about 20 mole % oxygen at a pressure between any pressure in the lower pressure column and any pressure in the higher pressure column to yield an intermediate pressure vapor;

(b) work expanding the intermediate pressure vapor and introducing the resulting work-expanded stream into the lower pressure column; and (c) providing the heat for vaporizing the liquid in step (a) by indirect heat exchange with at least a portion of a sidestream vapor withdrawn from the lower pressure column to yield a cooled intermediate stream.

2. The method of claim 1 wherein the condensed liquid containing at least about 20 mole % oxygen is provided by a portion of the bottoms liquid from the higher pressure column.

3. The method of claim 2 wherein the portion of the bottoms liquid from the higher pressure column is cooled and reduced in pressure prior to vaporization.

4. The method of claim 1 wherein the sidestream vapor of step (c) contains less than about 5 mole % nitrogen.

5. The method of claim 1 wherein the vaporizing of the condensed liquid in step (a) also yields an intermediate pressure liquid, which then is reduced in pressure and introduced into the lower pressure column.

6. The method of claim 1 wherein the cooled intermediate stream of step (c) is returned to the lower pressure column.

7. The method of claim 1 wherein the intermediate pressure vapor is warmed prior to work expansion.

8. The method of claim 1 which further comprises introducing the cooled intermediate stream of step (c) into an argon recovery distillation column.

9. The method of claim 8 which further comprises introducing a portion of the sidestream vapor withdrawn from the lower pressure column in step (c) into the argon recovery distillation column.

10. The method of claim 8 which further comprises cooling an argon-enriched overhead stream withdrawn from the argon recovery distillation column, returning at least a portion of the resulting cooled argon-enriched overhead as condensate to the column as reflux, and withdrawing a remaining cooled argon-enriched stream as a product.

11. The method of claim 10 wherein the vaporizing of the condensed liquid in step (a) also yields an intermediate pressure liquid, which is then reduced in pressure and warmed by indirect heat exchange with the argon-enriched overhead stream, thereby providing the cooled argon-enriched overhead and yielding a warmed, reduced-pressure intermediate stream.

12. The method of claim 8 which further comprises withdrawing a liquid bottoms stream from the argon recovery distillation column and introducing the liquid bottoms stream into the lower pressure column.

13. The method of claim 11 wherein the warmed, reduced-pressure intermediate stream is introduced into the lower pressure column.

14. The method of claim 1 wherein a nitrogen product is withdrawn from the top of the higher pressure column.

15. The method of claim 14 wherein the nitrogen product is withdrawn as a vapor and warmed to ambient temperature to provide a nitrogen gas product.

16. The method of claim 14 wherein the nitrogen product is withdrawn from the top of the higher pressure column as a liquid, the liquid is pumped to an elevated pressure, and the liquid is vaporized to provide a high pressure nitrogen gas product.

17. The method of claim 15 wherein another nitrogen product is withdrawn from the top of the higher pressure column as a liquid, the liquid is pumped to an elevated pressure, and the liquid is vaporized to provide a high pressure nitrogen gas product.

18. The method of claim 1 wherein an oxygen stream is withdrawn from the bottom of the lower pressure column to provide a primary oxygen product.

19. The method of claim 18 wherein an intermediate oxygen stream is withdrawn from a point above the bottom of the lower pressure column to provide an intermediate oxygen product.

20. The method of claim 18 wherein the purity of the intermediate oxygen product is less than the purity of the primary oxygen product.

* * * * *